US007186046B2

(12) United States Patent
Kauffmann et al.

(10) Patent No.: US 7,186,046 B2
(45) Date of Patent: Mar. 6, 2007

(54) BINARY APPLICATOR

(75) Inventors: Myriam Kauffmann, Paris (FR); Pascal Simon, Vitry sur Seine (FR)

(73) Assignee: L'Oreal, Paris (FR)

( * ) Notice: Subject to any disclaimer, the term of this patent is extended or adjusted under 35 U.S.C. 154(b) by 80 days.

(21) Appl. No.: 10/674,420

(22) Filed: Oct. 1, 2003

(65) Prior Publication Data

US 2004/0165935 A1 Aug. 26, 2004

Related U.S. Application Data

(60) Provisional application No. 60/428,706, filed on Nov. 25, 2002.

(30) Foreign Application Priority Data

Oct. 1, 2002 (FR) ..... 02 12155

(51) Int. Cl.
*B43K 5/14* (2006.01)

(52) U.S. Cl. ..... 401/132; 401/133; 401/134; 401/135

(58) Field of Classification Search ..... 401/132–135; 604/3

See application file for complete search history.

(56) References Cited

U.S. PATENT DOCUMENTS

| | | | | |
|---|---|---|---|---|
| 1,607,768 | A | 11/1926 | Meusel | |
| 3,757,782 | A * | 9/1973 | Aiken | 604/3 |
| 3,958,571 | A | 5/1976 | Bennington | |
| 4,740,194 | A * | 4/1988 | Barabino et al. | 604/3 |
| 5,143,210 | A | 9/1992 | Warwick et al. | |
| 5,152,742 | A | 10/1992 | Simpson | |
| 5,490,736 | A | 2/1996 | Haber et al. | |
| 5,702,035 | A | 12/1997 | Tsao | |
| 5,704,906 | A | 1/1998 | Fox | |
| 5,996,780 | A * | 12/1999 | Gurrera | 206/209 |
| 6,343,717 | B1 | 2/2002 | Zhang | |
| 2004/0116824 | A1 * | 6/2004 | Hirt et al. | 600/556 |
| 2005/0053413 | A1 * | 3/2005 | Tsaur | 401/133 |

FOREIGN PATENT DOCUMENTS

| | | |
|---|---|---|
| DE | 2920213 | 11/1980 |
| EP | 0 553 534 | 8/1993 |
| FR | 607405 | 7/1926 |
| FR | 1408584 | 8/1965 |

(Continued)

OTHER PUBLICATIONS

The catalog of the products sold by Swabplus, Incorporated (pp. 1-12).

*Primary Examiner*—Khoa D. Huynh
(74) *Attorney, Agent, or Firm*—Oblon, Spivak, McClelland, Maier & Neustadt, P.C.

(57) ABSTRACT

An applicator including at least one tube with at least one plug of a liquid or a powder inside the tube. At least a first substance is contained in an inside space of the tube, with the space defined at a first end by the liquid or powder plug. The plug is arranged, in use, to be expelled together with the first substance when it leaves the inside space of the tube. The applicator further includes at least one second substance different from the first substance and dissociated therefrom prior to use. Kit or packaging arrangements are also provided for containing one or more of the applicators.

63 Claims, 9 Drawing Sheets

FOREIGN PATENT DOCUMENTS

| | | |
|---|---|---|
| WO | WO 89/10156 | 11/1989 |
| WO | WO 97/06076 | 2/1997 |
| WO | WO 97/15385 | 5/1997 |
| WO | WO 97/15386 | 5/1997 |
| WO | WO 98/34581 | 8/1998 |
| WO | WO 00/09016 | 2/2000 |
| WO | WO 00/26280 | 5/2000 |
| WO | WO 01/17390 | 3/2001 |

* cited by examiner

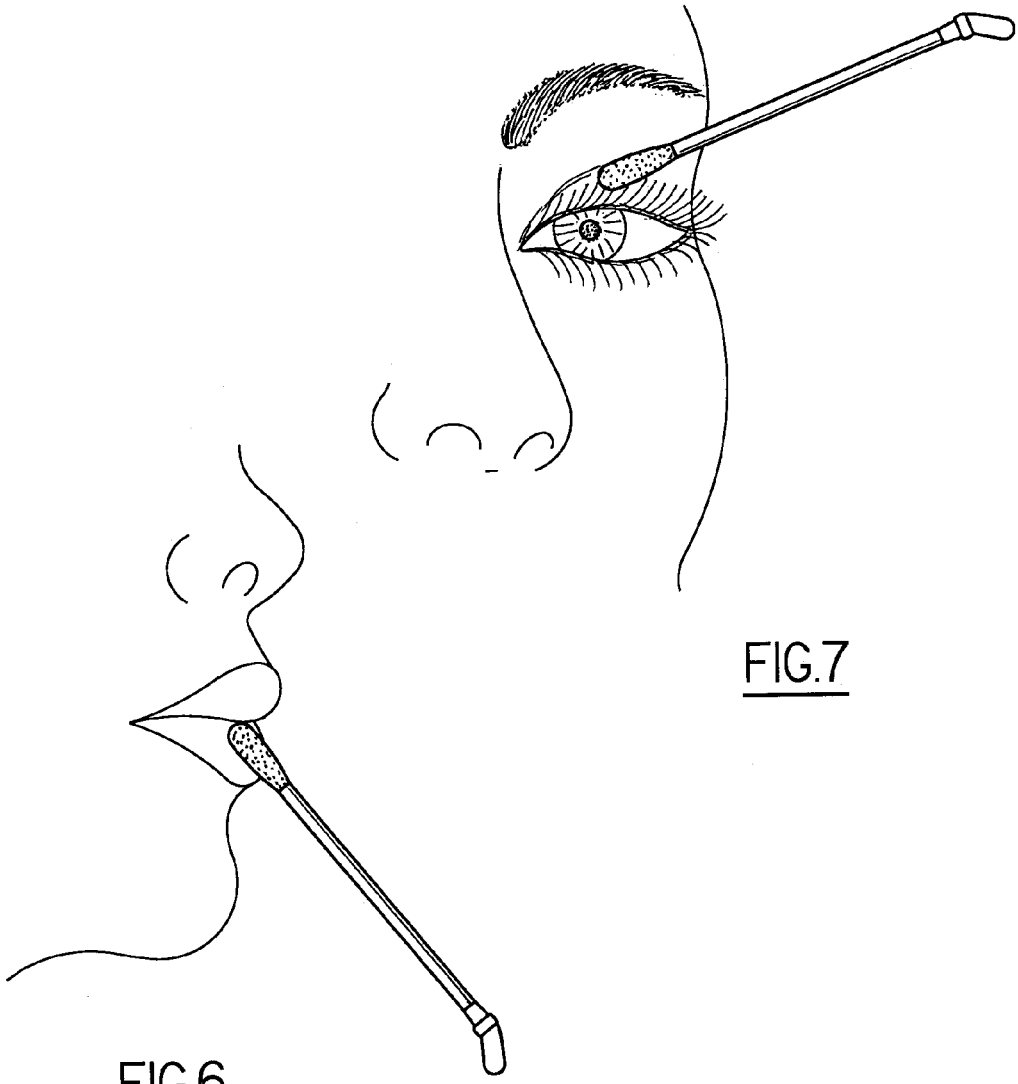
FIG.7
FIG.6
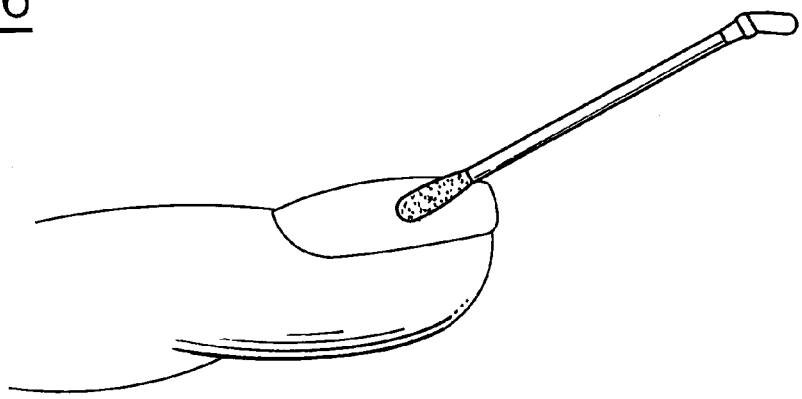
FIG.8

BINARY APPLICATOR

CROSS-REFERENCE TO RELATED APPLICATIONS

This application claims priority to French Application No. 02 12155, filed Oct. 1, 2002 and U.S. Provisional Application No. 60/428,706, filed Nov. 25, 2002, the entire content of both of which is hereby incorporated by reference.

FIELD OF THE INVENTION

The present invention relates to applicators enabling at least one substance, in particular a makeup or care product, to be applied to skin, hair, finger-nails or toe-nails.

BACKGROUND OF THE INVENTION

Discussion of Background

U.S. Pat. No. 3,958,571 discloses an applicator comprising a tube containing a liquid and having an applicator element at one end of the tube. Such an applicator is designed to apply medication such as an iodine solution.

Certain cosmetic packages, for example makeup removers, include a flask containing two phases: an aqueous phase, and an oily phase. To use the product, the flask is shaken to homogenize the composition. After use, it is found quite often that only one of the two phases remains in the flask, since users do not always homogenize the composition in satisfactory manner. This leads to substance being wasted and to variation in the relative proportions of the different ingredients during use which can be prejudicial to the effectiveness of the cosmetic.

It is also known that emulsions can be formed by using surfactants and thickeners to stabilize them, however such compounds can degrade the safety of the composition or can raise problems of conserving the active agents contained therein.

SUMMARY OF THE INVENTION

There exists a need for a novel applicator which is easily transportable, which is suitable for single use, which is relatively low in cost, and which is capable, in particular, of storing two substances separately prior to use.

There also exists a need to enable at least two phases to be packaged, while reducing the quantities of surfactant or thickener that are used, or indeed while using no surfactant or thickener, while still making it easier to ensure that each of the two phases is used up in full.

The present invention seeks to satisfy the above advantageous qualities in full or in part. The invention includes various features as described in the context of exemplary embodiments. However, it is to be understood that, in practicing the invention, each and every feature of a particular embodiment need not be present, and various combinations of the features of the illustrated embodiments are possible.

In one of its aspects, the invention provides an applicator including at least one tube, at least one plug of a powder or a liquid inside the tube, and at least a first substance contained in an inside space of the tube defined at a first end by the liquid or powder plug. The plug is arranged, in use, to be expelled together with the first substance when it leaves the inside space of the tube. The applicator further includes at least one second substance different from the first substance and dissociated therefrom prior to use.

The term "dissociated" is used to mean that the first and second substances are separated from each other by a third component which can be constituted, where appropriate, by a plug of liquid or powder, or else that they form at least two phases that are in contact with each other (e.g., with the two substances separated by capillary and/or surface tension forces without requiring a third component).

The invention enables at least two substances to be packaged at a low cost in the same applicator, e.g., substances that are for mixing extemporaneously or that are for application in succession on the skin, mucous membranes, the hair, or the nails.

When packaging at least two phases, the invention also makes it possible to stabilize these two phases without using a surfactant or a thickener, or at least makes it possible to use smaller quantities thereof.

The two phases can be kept dissociated from each other specifically by the capillary and/or surface tension forces they exert in association with the inside wall of the tube, even when the difference in kind between the two substances constituting the phases is relatively small, particularly when the two substances present little difference in terms of density or polarity, for example.

In one of its aspects, the invention thus makes it possible to remedy the above-mentioned problem of stabilizing a composition having a plurality of phases. When the two phases are constituted by first and second liquids inside the tube, one of the liquids can be an aqueous solution and the other an oily solution, for example. However, in accordance with the present invention, both liquids could be aqueous solutions or oily solutions or some other kind of solution.

The two substances can contain respective compounds that are incompatible, being unsuitable for being packaged together over a long period, and the presence of at least two phases can serve to limit the exchange area between the two substances, which can improve conservation or presentation of the compounds.

By way of example, the tube can contain two phases, each occupying a respective fraction of the length of the tube, with a single interface between the two phases.

One of the phases can be dispersed in the form of globules in the other phase, in particular in the form of globules disposed at substantially regular intervals along the tube, which can be advantageous for reasons of appearance and/or for measuring-out or dispensing purposes.

The tube can contain more than two substances corresponding to more than two phases. In particular, the tube can contain one phase having the other phase or phases dispersed therein in the form of globules. Each globule can correspond to a respective substance or plural globules can be formed of a given substance. In addition, the globules can optionally have a color or different colors corresponding to a different ingredient or different ingredients (or different concentrations of ingredients). Thus, the globules can contain the same substance or ingredient, or different substances or active ingredients, or the globules can contain active ingredients at different concentrations. In addition, where appropriate, the globules can be of different sizes.

In one of its aspects, the invention enables a two-phase or multiphase composition to be made stable without it being necessary to have recourse to the usual techniques of emulsification or of gelling. The invention makes it possible in particular to reduce the risk of migration or mixing during storage. In particular, the invention makes it possible to avoid the unsightly appearance of phases segregating in unwanted manner.

The invention thus makes it possible to package stably at least one two- or multiphase composition containing no wetting agents or without requiring wetting agents, and to reduce the concentration of preservatives, the substances being suitable for conservation when protected from air.

In addition, the invention enables use to take place without prior shaking, and with the relative proportions of the different phases being conserved over time.

An applicator of the invention can be suitable for single use.

The substances can also be packaged in the applicator in other ways, which can be combined with one or more of the above features.

In an embodiment of the invention, the applicator can include two tubes, each containing one substance, and preferably with a plug of a liquid or a powder inside each tube.

In another embodiment of the invention, the tube can include an internal partition defining two compartments containing respective substances. The partition can extend over the entire length of the tube, for example, with the partition being made together with the remainder of the tube by extruding plastics material.

The applicator can contain two substances that can be intended for mixing extemporaneously, for example substances containing components suitable for reacting together to form new components of short lifetime, the two components giving rise, for example, to a reaction such as effervescence, chemical or enzymatic hydrolysis, oxidation, said list not being limiting.

The applicator can include an applicator element, which can be porous, e.g., being fibrous.

By way of example, the applicator element can be selected from the group constituted by: a cotton bud; a foam bud; a felt tip; a flocked bud; a tip made of ceramic or of sintered material, or a pad, among others. The applicator element can also be in the form of a brush or a comb suitable for applying substance on the eyelashes, the eyebrows, the hair, the nails, the teeth, or the gums. Where appropriate, the applicator element can present abrasive properties.

In an embodiment of the invention, the second above-mentioned substance can impregnate or be dispersed in or stuck to the applicator element prior to use, or indeed it can form at least a portion thereof. The second substance can specifically be present in the form of a layer on the surface of the applicator element. The second substance can also be fixed or grafted onto fibers or bristles of the applicator element. Thus, by way of example, the applicator element can include fibers, in particular cellulose fibers, having a compound grafted or fixed thereon.

In a variant, the applicator need not have an applicator element.

When the plug is a liquid plug, the liquid of the liquid plug can be selected from the group constituted by: mineral oils; fluorine-containing substances; and silicones, this list not being limiting.

When the plug is a powder plug, its powder can include organic or inorganic particles that are solid or hollow, and can for example be a powder of copolymer microspheres such as Expancel® (Nobel Industrie), for example, Nylon® (e.g. Orgasol®), waxers, silicas, or silicones.

At a second end remote from the plug, the space inside the tube can be defined by an end portion of the tube that is removable, perforatable, or deformable, and possibly suitable for being broken off.

When the applicator includes two tubes, the end portion can be common to both tubes. In a variant, each tube can have its own independent removable portion, in particular a break-off portion.

The applicator element can include a retaining element, e.g., made of cotton, for retaining each break-off portion on the applicator after it has been broken off.

The volume of substance contained in the or each tube can, for example, lie in the range 0.01 milliliters (ml) to 5 ml, or 0.05 ml to 5 ml, or better 0.05 ml to 1 ml.

The or each tube can be made of transparent material, in particular a transparent plastics material, thereby enabling the user to see how much substance there is in each tube and/or to see the color thereof. The or each tube can include a multilayer structure, having at least one layer constituting a barrier against air, e.g., a layer of air-impermeable varnish, or forming a barrier against a solvent, or against ultraviolet (UV) radiation.

In another of its aspects, the invention also provides an applicator kit including at least one applicator as described above and a package in which the at least one applicator is disposed prior to use.

The package can include an individual applicator-packaging bag, which bag can be hermetically sealed, particularly when the applicator element is impregnated in a liquid, or the package can include a string of packaging bags each containing at least one applicator.

In a variant, the package can include a box in which at least one applicator can be housed.

The above-defined applicator can be used, for example, for applying makeup to or for removing makeup from the eyelashes or the eyebrows, the lips, the eyelids, the nails, or a portion of the face or the body or for tinting or bleaching hair, the eyelashes, or the eyebrows, or for mouth hygiene, in particular of the teeth or the gums, or for providing protection against the sun.

The applicator can also be used for applying a tattoo on the skin or for making a decorative mark by means of a self-tanning agent.

The invention also provides independently or in combination with the above, a method of application of at least a substance contained in an inside space of the tube, the method including heating the tube with a heat source before application of the substance. The substance can include, for example, at least a thermoreversible thickener so that the substance is reduced into a fluid state when the heat increases. The heat source can be human heat or a heat source outside the human body, for example, a source of hot water. Reducing the substance into a fluid state before application can improve the preservation of the substance during stocking in the tube, in particular by limiting the evaporation of the substance. Reducing the substance into a fluid state can also facilitate the passage of the substance through an application element, in particular an application element made of a porous material, for example cotton. The tube may or may not include a plug of one of a liquid and a powder disposed adjacent to the substance, this liquid or powder plug being arranged to be expelled together with the substance when the substance leaves the inside space of the tube, in use.

BRIEF DESCRIPTION OF THE DRAWINGS

Other characteristics and advantages of the invention will become apparent from the following detailed description, particularly when considered in conjunction with the drawings in which:

FIGS. 6 to 8 show various possible ways, among others, of using the applicator of FIGS. 2 to 4;

DETAILED DESCRIPTION OF THE PREFERRED EMBODIMENTS

Figure 1:
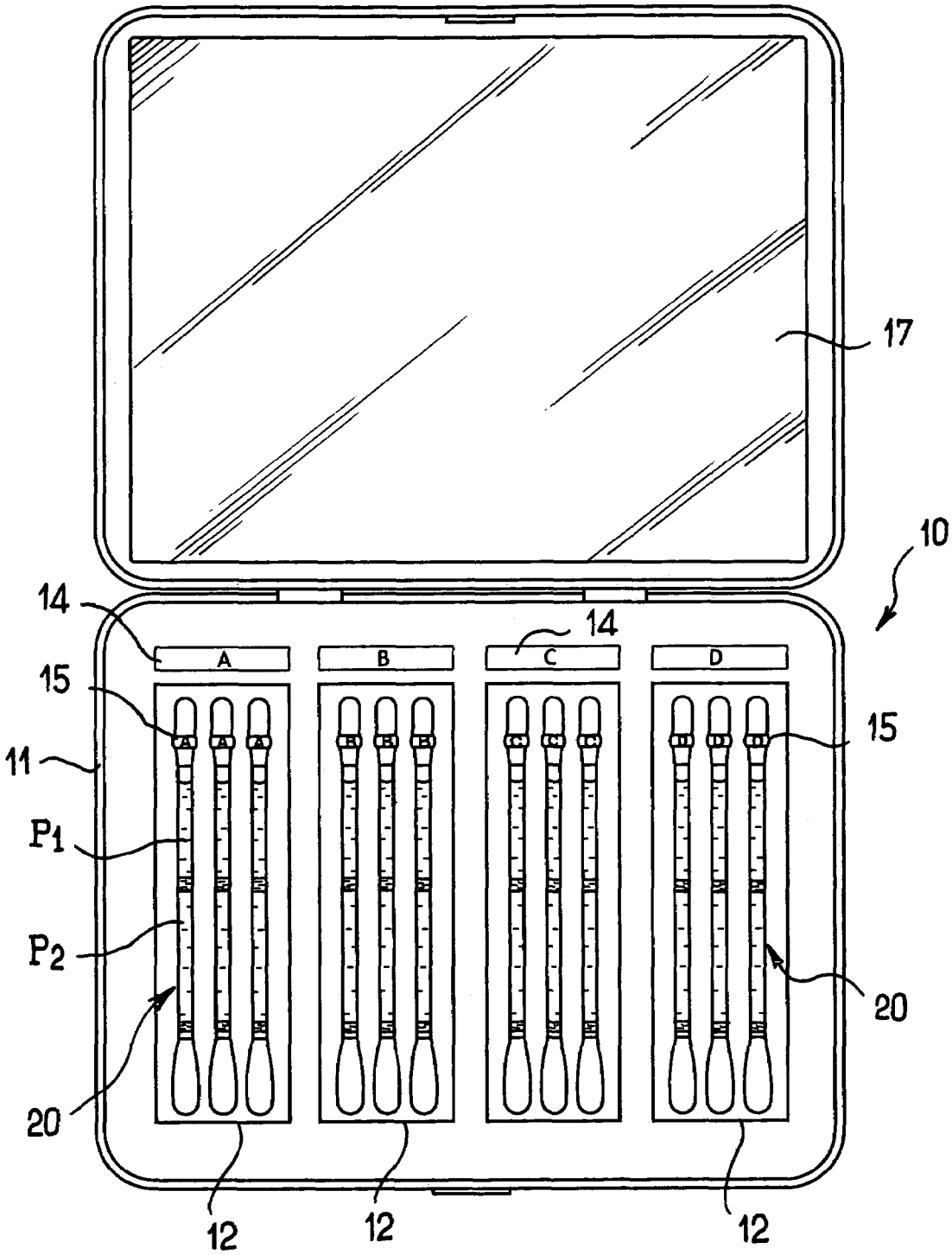
FIG. 1 is a diagrammatic view of an applicator kit constituting a first embodiment of the invention.

FIG. 1 shows an example of an applicator kit 10 made in accordance with the invention. The illustrated example includes a box 11 having a plurality of compartments 12, each receiving a plurality of applicators 20 each containing at least two substances $P_1$ and $P_2$, for example liquids, that form a cosmetic or care product on being mixed together, and that possibly contain active agents that are incompatible and that need to be stored separately.

The applicators 20 are arranged in the compartments 12 depending on the substances they contain. A label 14 serves to identify each compartment, and a mark 15 such as an alphanumeric symbol or a color can be present on each applicator 20.

The box 11 can also include a mirror 17 on the inside face of its lid.

Figure 2:
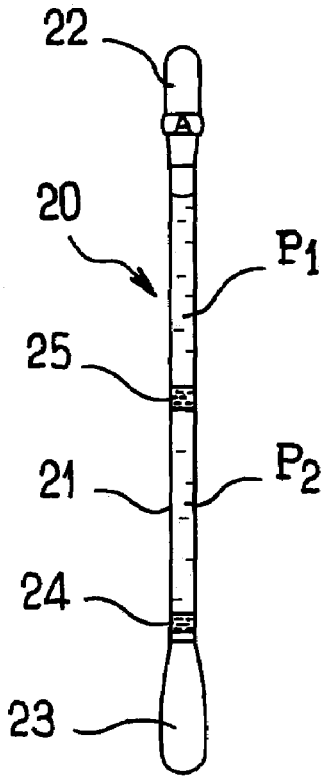
FIGS. 2 to 4 show an applicator in isolation.
Figure 3:
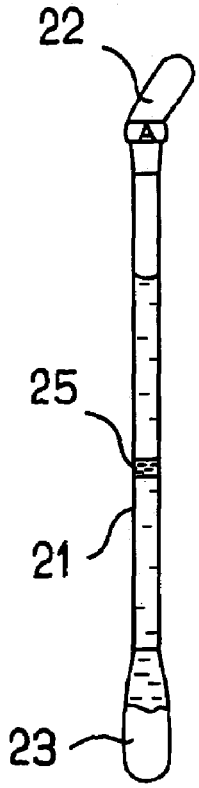
Figure 4:
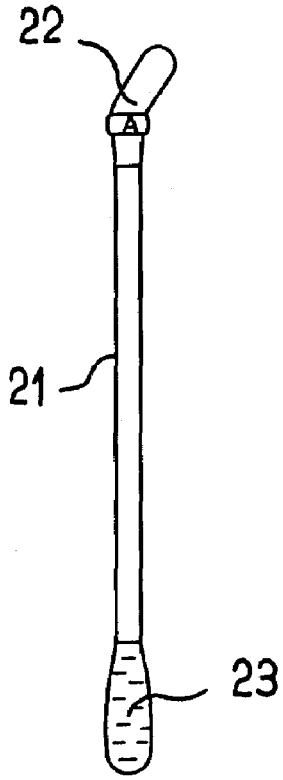
Figure 5:
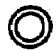
FIG. 5 is a cross-section view of the FIG. 2 applicator.

FIGS. 2 to 4 show an applicator 20 in isolation.

By way of example, this applicator can be similar to that described in U.S. Pat. No. 5,702,035, the content of which is incorporated herein by reference. Applicators of this type are sold by the Californian supplier Swabplus Inc.

The applicator 20 includes a tube 21 which, in the example described, contains two substances $P_1$ and $P_2$, the tube being made for example out of plastics material and being provided at a closed end with a break-off portion 22. In the example illustrated, this break-off end is optionally covered by a cotton bud. The tube 21 is open at its other end remote from the break-off portion 22, being provided at this other end with an applicator element 23, e.g., a cotton bud applicator.

In the example shown, the two substances $P_1$ and $P_2$ are contained in an inside space of the tube 21 situated between the break-off portion 22 and a first plug 24 present inside the tube 21, beside its open end, e.g., a plug of liquid. The substances $P_1$ and $P_2$ are separated from each other by a second plug 25, e.g. a plug of liquid.

The volumes of the substances $P_1$ and $P_2$ contained in the tube 21 can be suitable for a single use of the applicator, being determined as a function of the nature of the substances and of the intended application, and it can lie, for example, in the range 0.01 ml to 5 ml, or better in the range 0.05 ml to 1 ml. The outside diameter of the tube 21 is preferably less than 6 mm, for example, or even less than or equal to about 3 mm. The inside diameter of the tube 21 can lie in the range about 0.5 mm to about 3 mm, for example.

The material of the plugs 24 or 25 can be constituted by any suitable material such as an inert material that is compatible with packaging the substances $P_1$ and $P_2$ in the tube 21, in particular it can be a material that does not react with the substances $P_1$ and $P_2$, that is capable of being expelled easily from the tube 21 at the time of use, and that is also physiologically acceptable, for example it can be a mineral oil or a fluorine-containing substance, among others. In the example described, the plugs 24 or 25 are made of silicone.

The plug 24 serves specifically to isolate the substance $P_2$ from the air, preventing it from evaporating and preventing external contaminants from penetrating.

The quantity of liquid or powder constituting the plugs 24 and 25 is small relative to the quantity constituting the substances $P_1$ and $P_2$.

When the break-off portion 22 is broken off, air can penetrate into the tube 21 from its end remote from its open end, thereby enabling the substances $P_1$ and $P_2$ to flow out in succession under gravity from the tube 21 and onto the applicator element 23, as shown in FIGS. 3 and 4, where they can mix prior to being applied to the skin, for example. The plugs 24 and 25 are expelled together with the substances $P_1$ and $P_2$.

In the example described, the cotton bud covering the break-off portion 22 serves to hold it to the remainder of the tube 21, even after it has been broken off.

The applicator 20 can be used, for example, to apply the mixture of substances $P_1$ and $P_2$ to the lips, as shown in FIG. 6 to the eyelids as shown in FIG. 7, or to the nails as shown in FIG. 8.

The applicators 20 can be packaged in a box as shown in FIG. 1, but they can also be packaged in other packaging without thereby going beyond the scope of the present invention.

Figure 9:
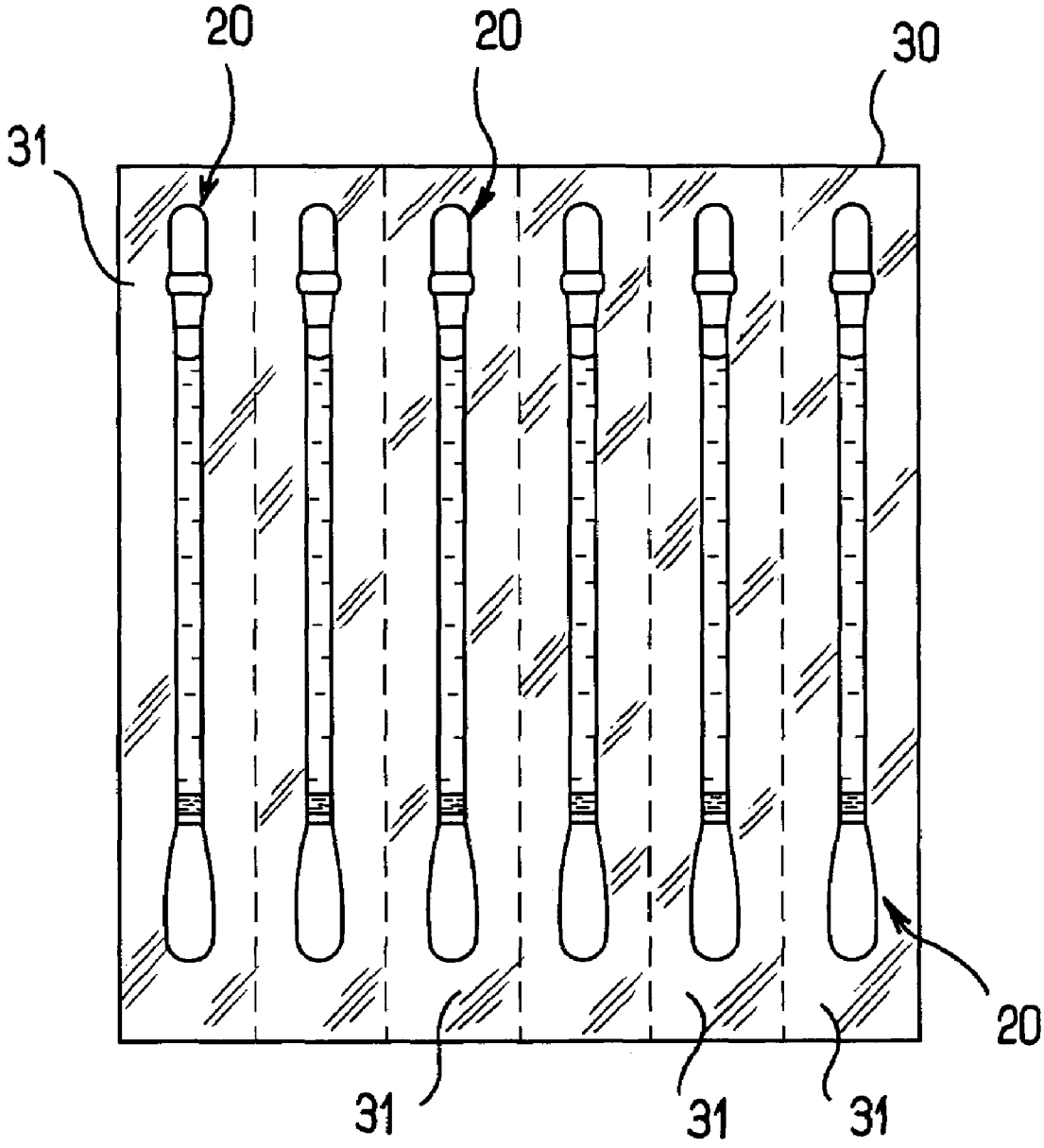
FIG. 9 shows another example of an applicator kit of the invention.

By way of example, the package can be constituted by a string 30 of bags 31, each containing one applicator 20, as shown in FIG. 9.

The applicator described with reference to FIGS. 1 to 9 contains two substances $P_1$ and $P_2$ in a single tube 21, with the substances being separated by a plug 25.

The applicator can present a different shape, and in particular as shown in FIGS. 10 to 13, it can include two distinct tubes 21 that are united along a common generator line. The applicator can have an applicator element 23 that is common to both tubes 21.

In the example illustrated, each tube 21 has a break-off portion that is independent from the break-off portion of the, other tube, and the two tubes contain substances $P_1$ and $P_2$ that are different from each other. Each tube also contains a plug 24 that is situated prior to use between the substance $P_1$ and $P_2$ and the applicator element, as is the case for the applicator described with reference to FIGS. 2 to 4.

Figure 10:
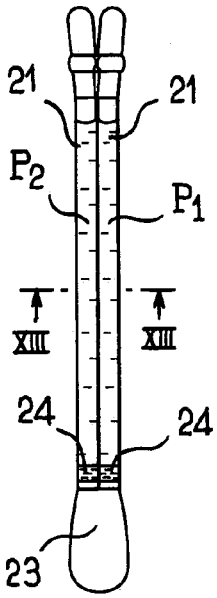
FIGS. 10 to 12 show another example of an applicator.
Figure 11:
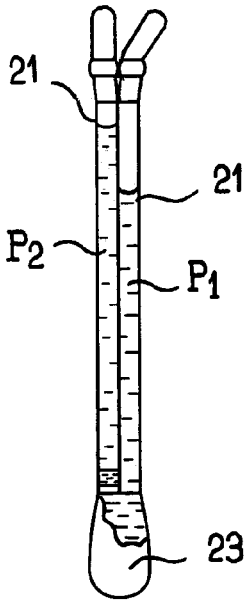
Figure 12:
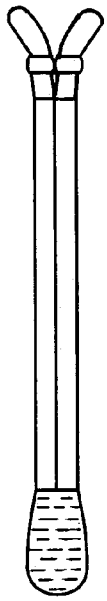
Figure 13:
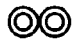
FIG. 13 is a diagrammatic cross-section on XIII—XIII of FIG. 10.

As shown in FIGS. 11 and 12, the applicator of FIG. 10 can be used firstly by breaking off the end portion 22 of the tube 21 containing the substance $P_1$, which substance then flows out into the applicator element 23. Thereafter, the break-off portion of the tube 21 containing the substance $P_2$ can be broken off so that the substance $P_2$ in turn flows out into the applicator element 23.

Such an applicator can be useful in applying two substances in succession to a surface, for example.

Figure 14:
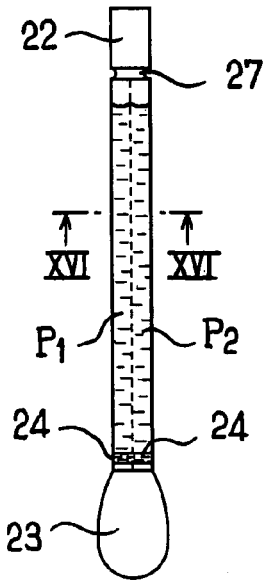
FIGS. 14 and 15 show another element of an applicator.
Figure 15:
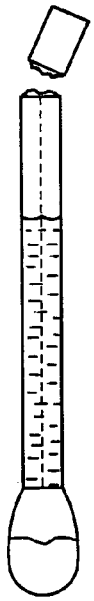
Figure 16:
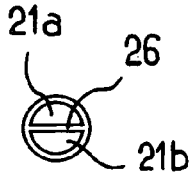
FIG. 16 is a diagrammatic cross-section on XVI—XVI of FIG. 14.

In another embodiment shown in FIGS. 14 to 16, the applicator can include a single tube having an internal partition 26 as shown in FIG. 16, which partition can be made, for example, by extrusion. The partition 26 defines two compartments 21*a* and 21*b* inside the tube 21, enabling the substances $P_1$ and $P_2$ to be kept separate prior to use. The tube 21 in the illustrated example has two plugs 24, each in a respective one of the compartments 21*a* and 21*b*, and a single break-off portion 22 common to both compartments 21*a* and 21*b*.

In the example described, the break-off portion does not have an element for holding it to the remainder of the tube after it has been broken off. It can be seen that the break-off portion 22 can be connected to the remainder of the tube by a preferred breakage zone 27, e.g., implemented in the form of a narrowing in the wall of the tube 21 or by a notch.

In order to break off the end of the tube 21, it is possible to apply a twisting movement by hand, holding the tube 21 in one hand and the break-off portion 22 between two fingers of the other hand.

When the end is broken off the tube 21, both substances $P_1$ and $P_2$ flow out simultaneously into the applicator element 23.

The applicator can be arranged in such a manner that after the end has been broken off, the user can measure out the quantity of liquid that moves downwards by handling the applicator like a pipette with its top end being closed off with the index finger, and with the tube optionally being inclined to a greater or lesser extent, where appropriate.

In an embodiment of the invention, the tube can be reclosed after only a fraction of the liquid contained inside has flowed out. It can be reclosed by using the break-off end, for example. By way of example, this end can be configured so as to be capable of constituting a closure plug, with the break-off end being in the form of a spike, for example, suitable for being engaged in or on the tube in order to close it.

Figure 17:
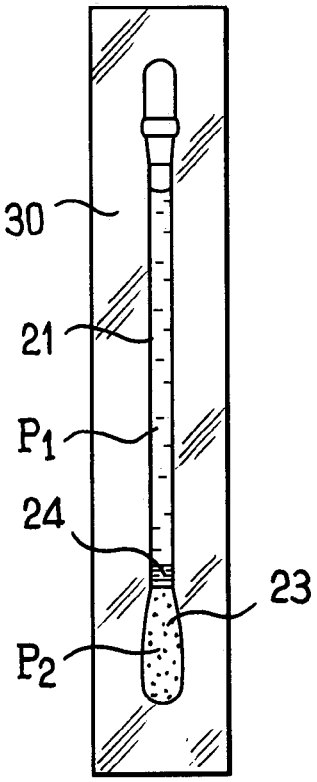
FIG. 17 shows another example of an applicator, packaged in a bag.

Another embodiment is shown in FIG. 17.

In this example, the applicator includes a tube 21 containing a substance $P_1$ while the applicator element 23 is pre-impregnated with a substance $P_2$ that is separated from the substance $P_1$ by the liquid plug 24.

By way of example, the substance $P_2$ can be in powder form, being dispersed in the applicator element 23, or it can be in liquid form.

By way of example, the substance $P_2$ can be a powder of emulsionable granules containing a liquid. Granules that disperse automatically in a liquid, in particular water, are described in applications Nos. WO 97/15386, WO 97/15385, and WO 00/26280. Such granules can include at least one active material in the form of a hydrophobic liquid, and at least one hydrosoluble compound suitable for forming a continuous film of solid material imprisoning or containing droplets of the hydrophobic active material.

Prior to use, the applicator can be contained in a hermetically-closed bag 30, particularly when the substance $P_2$ is a liquid.

When the substance $P_2$ is a solid, the substance $P_1$ can be a liquid and/or a dispersant, suitable for dissolving or dispersing the substance $P_2$, and it can be selected for example from the group constituted by: pure water, an aqueous or oily solution, a solution containing at least one wetting agent, a fluorine-containing solvent, with this list not being limiting.

Figure 18:
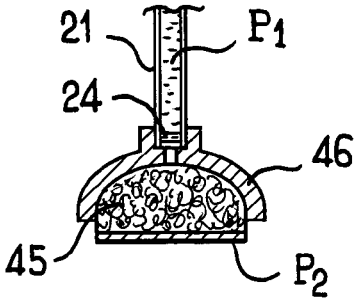
FIG. 18 shows another example of an applicator element.

The substance $P_2$ can be distributed throughout the applicator element or it can occupy only a portion thereof, e.g., being in the form of a layer present on the surface of the applicator element, as shown in FIG. 18. This figure shows that a support 46 in the form of a cup can be fixed to the end of the tube 21, the support carrying a pad 45 of a material that is elastically deformable and porous, with a layer of the substance $P_2$ for application to the skin being deposited on the surface thereof.

The substance $P_1$ contained in the tube 21 can serve to dissolve a binder retaining the substance $P_2$ at the surface of the pad 45, for example, thereby enabling the substance $P_2$ to be transferred onto the skin in order to make a tattoo.

Figure 19:
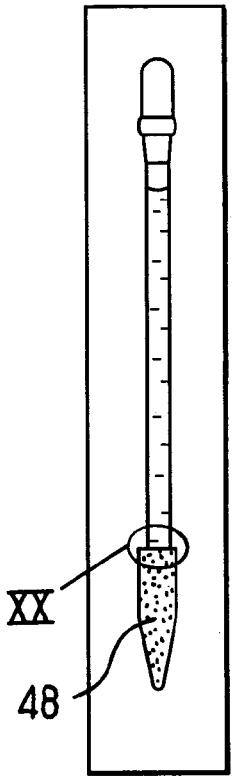
FIG. 19 shows another example of an applicator packaged in a bag.

The substance $P_2$ can also be configured to form at least a portion of the applicator element, as shown in FIG. 19. This figure shows that the substance $P_2$ can be implemented in the form of a solid block 48, for example, which block is fixed to the end of the tube 21. The substance $P_2$ is porous, for example, so that the substance $P_1$ can impregnate it easily and enable it to be transferred onto the surface to be treated. By way of example, the applicator element can be configured so as to disperse progressively in order to deposit material suitable for filling in wrinkles, for example.

Figure 20:
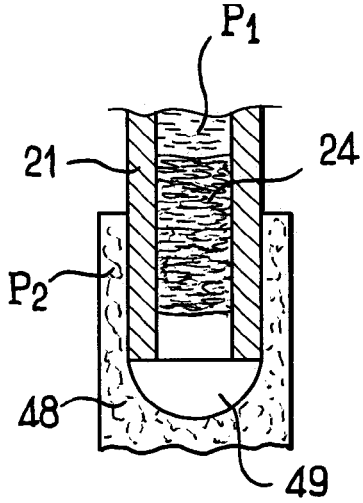
FIG. 20 is a diagrammatic section of detail XX in the FIG. 19 applicator.

FIG. 20 shows that the block 48 of substance $P_2$ can include a housing 49 in which the end of the tube 21 is received.

Figure 21:
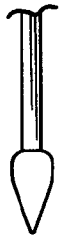
FIGS. 21 to 30 show other examples of applicator elements.

The applicator element can present a variety of shapes, for example, its end can be rounded or pointed. For example, the applicator can include the shape of a pennant, as shown in FIG. 21.

Figure 22:
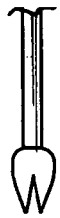

The applicator element can also be forked in shape as shown in FIG. 22, e.g., for the purpose of making it easier to take hold of a lock of hair, an eyelash, or an eyebrow hair.

Figure 23:
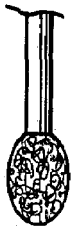
Figure 24:
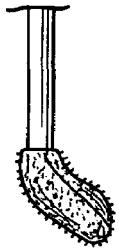

The applicator element can also be in the form of a foam bud, as shown in FIG. 23, a flocked bud as shown in FIG. 24, a ceramic tip, or a tip of sintered material. FIG. 24 shows that the applicator element can present an off-center shape, e.g. a shape that is adapted to the way makeup is to be applied or to the shape of the region of the body or the face on which the substances are to be applied.

When the applicator element includes a porous bud, it can be implemented in such a manner as to have pores or cells containing the substance $P_2$ or some other additional compound, with at least some of the pores or cells optionally having their structure modified in use so as to release the substance $P_2$ or the additional compound.

The applicator element can include a bud made of foam, in particular polyurethane foam, having microcapsules deposited therein containing the substance $P_2$ or an additional compound. The bud can also be made of a foam of elastomer, silicone, ethylene vinyl acetate (EVA), polysulfane, polyethylene, among others. At least some of the cells of the foam may burst on being pressed against the skin, or the walls of the cells can be dissolved at least in part by the substance $P_1$ during use, in order to release the substance $P_2$ or the additional compound.

Figure 25:
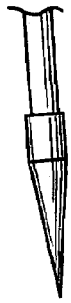
Figure 26:
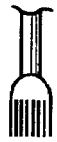
Figure 27:
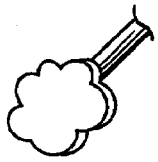

The applicator element can also be made to have a tapering shape as shown in FIG. 25, e.g., to apply an eyeliner, or it can be in the form of a paintbrush, in particular for applying substance to the nails, as shown in FIG. 26, or indeed it can be in the form of a pad, in particular a pad including a decorative pattern, as shown in FIG. 27.

Figure 28:
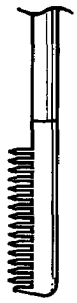
Figure 29:
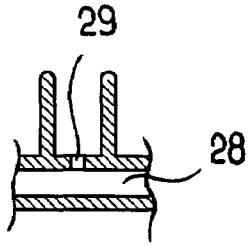

The applicator element can be implemented in the form of a comb as shown in FIG. 28. FIG. 29 shows that the comb can include an internal channel 28 communicating with the tube 21 so as to enable the substances $P_1$ and $P_2$ to reach at least one orifice 29 made at the bottom or base of the teeth. In a variant that is not shown, the outlet orifices can open out in the ends of the teeth.

Figure 30:
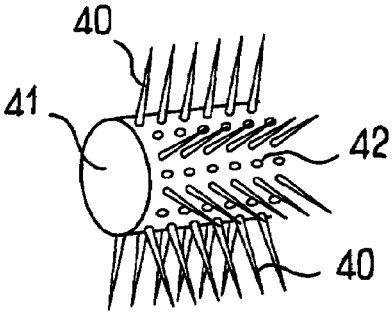

The applicator element can also be made in the form of a brush by injection-molding a plastics material, for example a brush as shown in FIG. 30 that includes a support 41 carrying a plurality of radially-directed bristles 40, with substance-delivery orifices 42 being located in the support, between the bristles.

The applicator element can also present adhesive and/or abrasive properties.

The applicator element can include solid particles or any material suitable for performing peeling or pumicing, for example, a mineral powder such as pumice stone, glass, corundum, metal, an organic powder, wood fibers, or particles of plastics material.

The abrasive effect can be used, for example, to polish the teeth or to treat hyperkeratinized skin, or to polish the nails and eliminate cuticle, this list of applications not being limiting.

Figure 31:
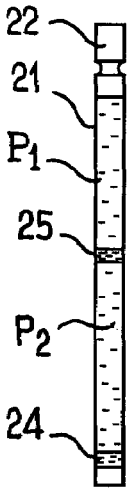
FIG. 31 shows another example of an applicator of the invention having no applicator element.

The applicator 20 need not have an applicator element, as shown in FIG. 31. Such an embodiment can be of use, particularly when the substances $P_1$ and $P_2$ contained in the tube 21 are for depositing in the form of a drop on the surface of the skin, for example.

The break-off portion 22 can be entirely separated from the tube 21, as described above with reference to FIG. 15.

Figure 32:
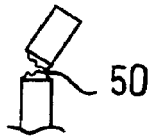
FIG. 32 shows a variant embodiment of the break-off portion of the tube.

In accordance with another variant, the applicator can be configured in such a manner that the break-off portion 22 remains held to the tube 21 after use, as shown in FIG. 32, by means of a bridge of material 50.

By way of example, the end of the tube 21 remote from the end through which the substance leaves can be closed other than by means of a portion that can be broken off manually, for, example it can be closed by means of a plug or a piston, e.g., in one of the ways shown in FIGS. 3 to 8 of U.S. Pat. No. 3,958,571, the contents of which are incorporated herein by reference.

The tube 21 can be made to have an enlarged portion, e.g., serving to exert pressure on the substance in order to expel it from the tube.

The applicators described above are suitable for a wide variety of applications, depending on the natures of the substances $P_1$ and $P_2$.

The substances $P_1$ and $P_2$ can be applied simultaneously onto a single surface for treatment, or they can be applied successively.

The substances $P_1$ and $P_2$ can optionally react with each other.

With the applicator of FIG. 19 in particular, the substance $P_2$ can be suitable for being applied by transfer without being dissolved or dispersed by the substance $P_1$. The user can thus begin by applying the substance $P_2$, and then once it has been applied, the user can act on the tube 21 to release the substance $P_1$ contained therein. The substance $P_1$ can then be deposited on the already-treated surface. It is thus possible, for example, to begin by applying the substance $P_2$ as makeup for providing color, and then to use the substance $P_1$ to confer shine or gloss to the makeup or to improve the retention of the substance $P_2$ on the treated surface.

When a substance $P_2$ is present in the applicator element or constitutes at least a portion thereof, the substance $P_2$ can be intended specifically to react with the substance $P_1$, in particular in order to produce a reaction that is exothermal, endothermal, or that produces effervescence.

By way of example, the substance $P_1$ can include acetic acid or any other physiologically acceptable acid, and the applicator element can include sodium carbonate or any other salt capable of reacting with the acid contained in the tube in order to give off gas. At least one of the substances $P_1$ and $P_2$ can also include at least one compound that acts on the skin, for example to whiten it, purify it, etc. It can be useful for gas to be given off in order to enhance the action of this compound or to provide an audible or visible indication concerning the length of time during which the treatment is to be continued. For example, the user can be advised to use the applicator to perform treatment so long as effervescence continues. This can help reduce the risk of the applicator being used for a length of time that is too short for treatment to be effective.

Effervescence can also be used to generate foam that makes cleansing or makeup removal easier, or that serves to distribute substance over keratinous fibers.

Where appropriate, the applicator element can include a compound that changes color on reacting with the substance $P_1$ contained in the tube. In the limit, the substance $P_2$ can serve solely to produce such a change in color, which change in color can enable the user to see that the applicator element has been impregnated by the substance $P_1$, with this being useful particularly when the substance $P_1$ is transparent or relatively viscous and when it is necessary to ensure that some minimum length of time has been allowed to elapse in order to enable the substance $P_1$ to impregnate the applicator element in satisfactory manner. Under such circumstances, the user should proceed with application only once the applicator element has completely changed color.

The substances $P_1$ and $P_2$ present in the applicator can also be compounds enabling keratinous fibers to be tinted or bleached.

By way of example, the applicator element can include a substance $P_2$ such as an oxidizing powder, and the substance $P_1$ contained in the tube can be an oxidizing dye, thus making it possible to tint or bleach the eyelashes, the eyebrows, or to treat the roots of the hair.

The substance $P_2$ can also include fibers that are to be dispersed by the substance $P_1$ over the treated surface, e.g., the skin, the eyelashes, or the eyebrows, so as to be spread out therein in preferred directions, e.g., obtaining elongating, enlarging, glossy, or other optical effects.

The substance $P_2$ contained in the applicator element can include a swelling polymer, for example a polymer suitable for reacting with water, with the substance $P_2$ reacting in contact with the substance $P_1$ to form a gel or a cream. Specifically, the substance $P_2$ can be suitable for forming a film on the surface of the lips, in particular a glossy film or a protective film. The substance $P_2$ can also be configured to form a gel for the eyelashes or the eyebrows enabling them to be shaped, for example. With a glossy lipstick, or a gel for the eyelashes or the eyebrows, the substance $P_1$ can include an oil, for example.

One of the substances $P_1$ can contain an ingredient whose effect on the skin or the hair or the nails does not appear until a certain amount of time has elapsed, and the other substance contained in the applicator can serve to show the user where the first substance has been applied. In an example, one of the substances can thus contain a self-tanning agent and the other can contain ink showing the user where the applicator has passed over the treated surface. The substance containing the self-tanning agent can contain dihydroxyacetone (DHA) in the concentrated state, for example.

Where appropriate, the applicator can be used in association with a sensor so as to apply tattoos or facilitate a localized treatment.

Independently of the substance $P_1$ contained in the tube, or of the substance $P_2$ optionally associated therewith, the applicator element can present heat-generating, hemostatic, or biocidal properties. By way of example, the applicator element can include a heat-generating wadding such as methyl nicotinate or Coalgan. The applicator element can also include waxes or polymers.

Figure 33:
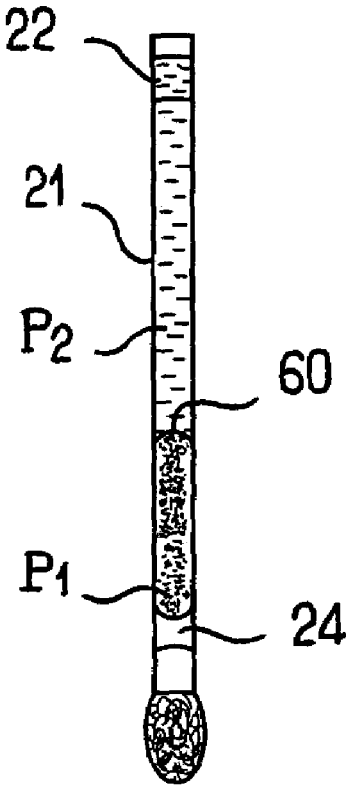
FIGS. 33 and 34 are diagrams showing applicators containing two-phase or multiphase compositions.

FIG. 33 shows a tube 21 containing two liquids $P_1$ and $P_2$ in the form of two phases, each occupying a fraction of the length of the tube.

These two phases can be of different colors, where appropriate.

By way of example, the substances can include an oily phase and an aqueous phase for use in removing makeup, the aqueous phase including a wetting agent, for example.

The two substances $P_1$ and $P_2$ come into contact with each other via an interface 60. The capillary and surface tension forces which are exerted by the small-diameter tube on the two phases enables them to be kept well separated.

Figure 34:
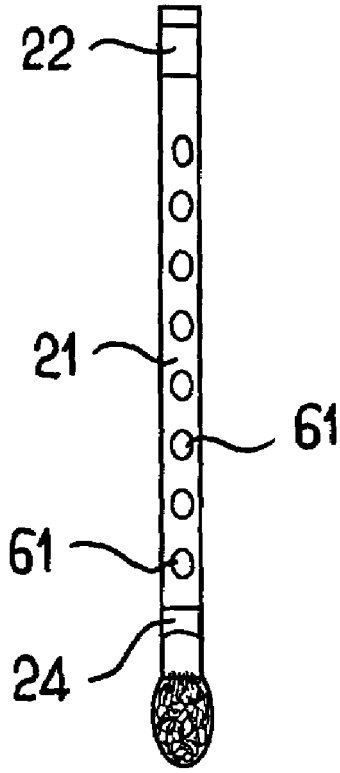

Alternatively, one of the substances can also be in the form of at least one globule inside the other phase, for example in the form of a plurality of globules 61 as shown in FIG. 34. This can make it possible, for example, to measure substance out by using the tube as a pipette, or it can serve to improve the appearance of the applicator.

A plurality of different liquids can be dispersed in the form of a plurality of globules in a single phase. The various globules can thus correspond to substances having different colors and/or containing different quantities; of active agent and/or agents of different kinds.

The substance $P_2$ can also be in a solid state while it is contained in the tube, e.g., being constituted by a, powder that is soluble in the substance $P_1$ the substances $P_1$ and $P_2$ being separated by a plug prior to use. By way of example, the substance $P_2$ can be vitamin C or an oxidizing powder. The volume of the substance $P_2$ can be small enough to ensure that the substance $P_2$ dissolves easily in use.

Specifically, the number of substances present in the applicator can be greater than two without going beyond the scope, of the present invention. Similarly, the end of the tube which is put into communication with air at the time of use can be made differently.

Figure 35:
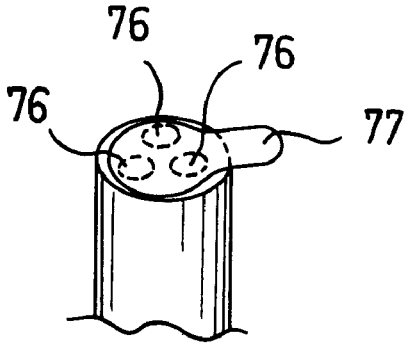
FIG. 35 is a diagrammatic and fragmentary view of a variant applicator of the invention.

FIG. 35 shows the top end of a, tube which, by way of example, has three internal channels 76 each containing a liquid and an associated plug, the tube being closed at the top end prior to use by a removable capsule 77, which capsule can be, for example, stuck or heat-sealed to the tube.

Figure 36:
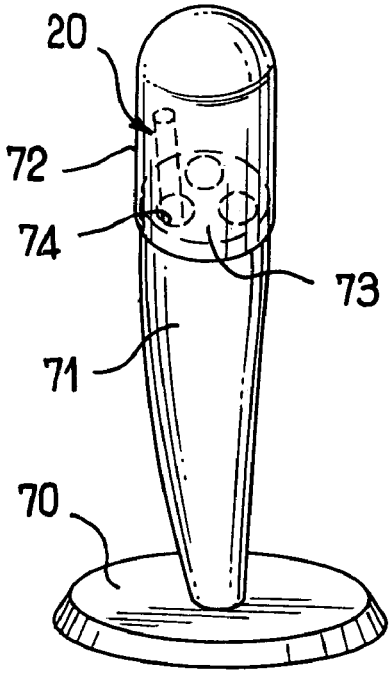
FIG. 36 is a diagram of an applicator packaged in a receptacle.

FIG. 36 shows a receptacle suitable for receiving an applicator before or after use. Such a receptacle can include, for example, a stand 70 supporting a body 71 whose top end is configured to enable a closure cap 72 to be secured thereto so as to close the receptacle in substantially leaktight manner. A support element 73 is placed inside the body 71 and has at least one orifice in which an applicator 20 can be engaged.

Thus, after performing an application, the user can place the applicator inside the receptacle to be used again at a later time, if so desired. The presence of the cap 72 makes it possible to prevent the applicator element drying out.

Figure 37:
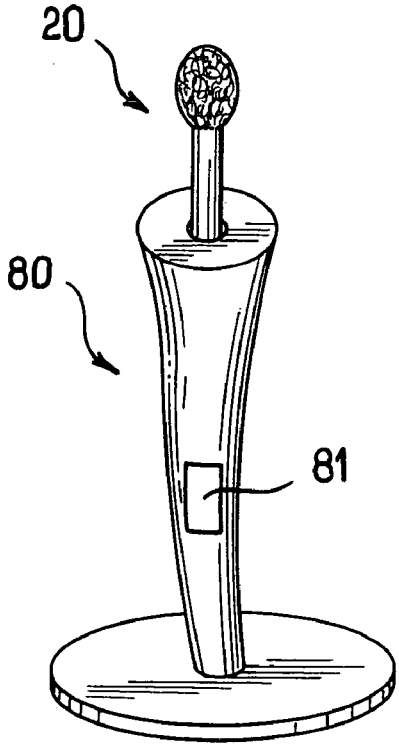
FIG. 37 is a diagram showing an example of an applicator-carrier.

It is also possible to use a support 80 as shown in FIG. 37 in association with at least one applicator, the support serving to hold the applicator with its applicator element visible, said support optionally including means 81 enabling the break-off end to be broken off when the applicator is put into place in the support 80. By way of example, the means 81 can include a window giving access to the break-off end, or an element that is movable relative to the support and that applies lateral thrust to the break-off end when actuated. Indeed, the tube need not have a break-off end, but can merely have an end that is closed, and the support can be fitted with a blade or a spike, for example, serving to cut off or to pierce the tube so as to allow air to penetrate therein, thus allowing the liquid and the plug to move out towards the applicator element when the applicator is used.

Throughout the description, including in the claims, terms such as including, having, has, or comprising should be understood as being synonymous with "comprising at least one" unless specified to the contrary.

The term "tube" is used to mean any body that is preferably generally elongate, of a section that is optionally constant, and that presents at least one internal channel suitable for containing a liquid, and such a tube can present a longitudinal axis that is rectilinear or otherwise. The invention is not limited to a tube of circular outside section, nor is it limited to a tube made in accordance with the teaching of U.S. Pat. No. 5,702,035.

Obviously, numerous modifications and variations of the present invention are possible in light of the above teachings. It is therefore to be understood that, within the scope of the appended claims, the invention can be practiced otherwise than as specifically described herein.

What is claimed as new and desired to be secured by Letters Patent of the United States is:

1. An applicator comprising:

at least one tube;

at least one plug disposed inside the tube, said at least one plug comprising at least one of a liquid and a powder; and at least a first substance contained in an inside space of the tube, wherein a first end of the inside space is defined by the plug, said plug being arranged, in use, to be expelled together with the first substance when it leaves the inside space of the tube;

the applicator further comprising at least one second substance different from the first substance and dissociated therefrom prior to use, the second substance being contained within either said at least one tube or a second tube, the first and second substances being contained in the applicator such that the first and second substances are expelled at a same end of the applicator.

2. The applicator according to claim 1, wherein the first and second substances are separated from each other by an extra component.

3. The applicator according to claim 2, wherein the extra component is a plug comprising at least one of a liquid and a powder.

4. The applicator according to claim 1, wherein the first and second substances constitute two phases that are in contact with each other.

5. The applicator according to claim 1, wherein the first and second substances contain respective compounds that are incompatible.

6. The applicator according to claim 4, wherein the two phases occupy respective fractions of the length of the tube, with a single interface between the phases.

7. The applicator according to claim 4, wherein one of the phases is dispersed in the other phase in the form of globules.

8. The applicator according to claim 7, wherein the globules are disposed at regular intervals from one another.

9. The applicator according to claim 4, wherein the tube contains more than two substances corresponding to more than two phases.

10. The applicator according to claim 1, wherein the applicator includes two tubes each containing a substance.

11. The applicator according to claim 10, wherein a plug comprising at least one of a liquid and a powder is disposed inside each tube.

12. The applicator according to claim 1, wherein the tube includes an internal partition defining two compartments in which the substances are contained, respectively.

13. The applicator according to claim 12, wherein at least one of the compartments extends over the full length of the tube.

14. The applicator according to claim 1, further including an applicator element.

15. The applicator according to claim 14, wherein the applicator element is porous.

16. The applicator according to claim 14, wherein the applicator element is selected from the group consisting of: a cotton bud; a foam bud; a felt tip; a flocked bud; a tip made of ceramic or of sintered material; and a pad.

17. The applicator according to claim 14, wherein the applicator element includes one of a brush and a comb.

18. The applicator according to claim 14, wherein the second substance impregnates the applicator element.

19. The applicator according to claim 14, wherein the second substance is dispersed in the applicator element.

20. The applicator according to claim 14, wherein the second substance is grafted on one of fibers and bristles of the applicator element.

21. The applicator according to claim 14, wherein the second substance is fixed on one of fibers and bristles of the applicator element.

22. The applicator according to claim 14, wherein the second substance is configured to form at least a portion of the applicator element.

23. The applicator according to claim 14, wherein the second substance is present in the form of a layer of a surface of the applicator element.

24. The applicator according to claim 1, wherein the applicator does not include an applicator element.

25. The applicator according to claim 1, wherein the at least one plug includes at least one liquid selected from the group consisting of: mineral oils; fluorine-containing substances; and silicones.

26. The applicator according to claim 1, wherein the at least one plug comprises at least one powder having a material selected from the group consisting of: powders of copolymer microspheres; Nylon®; a polyamide; waxes; silicas; and silicones.

27. The applicator according to claim 1, wherein the inside space is defined at a second end remote from the plug by a portion of the tube that is suitable for being broken off, removed, perforated, or deformed.

28. The applicator according to claim 10, wherein the inside space is defined at a second end remote from the plug by a portion of the tube that is suitable for being broken off, removed, perforated, or deformed, and wherein said portion is common to both tubes of the applicator.

29. The applicator according to claim 10, wherein the inside space of each tube is defined at a second end remote from the plug by a portion of each tube that is suitable for being broken off, removed, perforated, or deformed, and wherein the portion of each tube is independent so that the portion of each tube can be broken off, removed, perforated, or deformed independent of the portion of the other tube.

30. The applicator according to claim 27, including a retaining element for retaining said portion on the applicator after being broken off.

31. The applicator according to claim 1, wherein the volume of substance contained in the at least one tube lies in the range 0.01 ml to 5 ml.

32. The applicator according to claim 1, wherein the volume of substance contained in the at least one tube lies in the range 0.05 ml to 1 ml.

33. The applicator according to claim 1, wherein the at least one tube is transparent.

34. The applicator according to claim 1, wherein the first and second substances are unsuitable for being stored in contact with each other.

35. The applicator according to claim 1, further including packaging in which at least one of said applicators is disposed prior to use.

36. The applicator according to claim 35, wherein the packaging comprises an individual packaging bag for the applicator.

37. The applicator according to claim 36, wherein the bag is hermetically sealed.

38. The applicator according to claim 35, wherein the package comprises a string of bags each containing at least one applicator.

39. The applicator according to claim 35, wherein the package comprise a box in which at least one applicator can be housed.

40. An applicator as recited in claim 1, wherein said first and second substances are a nail care product.

41. An applicator as recited in claim 1, wherein said first and second substances are a hair care product.

42. An applicator as recited in claim 1, wherein said first and second substances are a make-up product.

43. An applicator as recited in claim 1, wherein said first and second substances are an eye make-up product.

44. An applicator as recited in claim 1, wherein said first and second substances are a lip make-up product.

45. An applicator as recited in claim 1, wherein said first and second substances are at least one of a make-up, a skin care product, a make-up remover, a hair product and a nail product.

46. An applicator as recited in claim 1, wherein said first substance and said second substance are a sunless tanning product.

47. An applicator arrangement comprising:

an applicator comprising:

(a) at least one tube;

(b) a first substance disposed in the at least one tube;

(c) a second substance, wherein the second substance is dissociated from the first substance at least during a time prior to use, the second substance being contained within either said at least one tube or a second tube, the first and the second substances being contained in the applicator so as to be expelled at a same end of the applicator; and (d) a plug, said plug comprising at least one of a liquid and a powder, and wherein, in use, at least a portion of said plug is expelled from said at least one tube along with said first substance, and wherein said plug is positioned at a location prior to use, said location being at least one of: (i) a location between said first substance and an exterior of said applicator, and (ii) a location between said first substance and said second substance.

48. An applicator arrangement as recited in claim 47, wherein said plug is located between said first substance and an exterior of said applicator.

49. An applicator arrangement as recited in claim 48, wherein said second substance is provided as a plurality of globules in said first substance.

50. An applicator arrangement as recited in claim 47, wherein said applicator includes an applicator portion at one end of the at least one tube, and wherein said second substance is associated with said applicator portion, and further wherein said plug is positioned to close said one end of said at least one tube such that said plug is disposed both at a location which is both between said first substance and an exterior of said tube and between said first substance and said second substance.

51. An applicator arrangement as recited in claim 47, wherein a plurality of said plugs are provided.

52. An applicator arrangement as recited in claim 51, wherein said plurality of plugs include a first plug disposed at a location between said first substance and an exterior of said applicator, and a second plug disposed between said first substance and said second substance.

53. An applicator arrangement as recited in claim 51, wherein at least two tubes are provided including a first tube containing said first substance and a second tube containing said second substance, and wherein said plurality of plugs include a first plug closing an end of said first tube and a second plug closing an end of said second tube.

54. An applicator arrangement as recited in claim 53, wherein said first and second tubes are independently openable.

55. An applicator arrangement as recited in claim 53, wherein a common opening device is provided for simultaneously opening said first and second tubes.

56. An applicator arrangement as recited in claim 47, further including a packaging assembly containing a plurality of said applicators.

57. An applicator arrangement as recited in claim 47, wherein said first and second substances are a nail care product.

58. An applicator arrangement as recited in claim 47, wherein said first and second substances are a hair care product.

59. An applicator arrangement as recited in claim 47, wherein said first and second substances are a make-up product.

60. An applicator arrangement as recited in claim 47, wherein said first and second substances are an eye make-up product.

61. An applicator arrangement as recited in claim 47, wherein said first and second substances are a lip make-up product.

62. An applicator arrangement as recited in claim 47, wherein said first and second substances are at least one of a make-up, a skin care product, a make-up remover, a hair product and a nail product.

63. An applicator arrangement as recited in claim 47, wherein said first substance and said second substance are a sunless tanning product.

* * * * *